United States Patent [19]

Nutcher

[11] 4,445,843

[45] May 1, 1984

[54] LOW $NO_x$ BURNERS

[75] Inventor: Peter B. Nutcher, Venetia, Pa.

[73] Assignee: Process Combustion Corporation, Pittsburgh, Pa.

[21] Appl. No.: 379,086

[22] Filed: May 17, 1982

[51] Int. Cl.[3] ..... F23L 9/00

[52] U.S. Cl. ..... 431/115; 431/190; 431/351; 122/197

[58] Field of Search ..... 431/10, 115, 116, 187, 431/188, 190, 202, 243, 347, 351, 352, 353; 110/182.5; 122/356, 197; 266/270

[56] References Cited

U.S. PATENT DOCUMENTS

| | | | |
|---|---|---|---|
| 3,146,821 | 9/1964 | Wuetig | 431/115 |
| 3,495,815 | 2/1970 | Holmes | 266/270 |
| 4,021,188 | 5/1977 | Yamagishi et al. | 431/158 |
| 4,289,093 | 9/1981 | Coggins et al. | 122/197 |
| 4,351,632 | 9/1982 | Nagai | 431/183 |

*Primary Examiner*—Lee E. Barrett

*Attorney, Agent, or Firm*—Webb, Burden, Robinson & Webb

[57] ABSTRACT

Fired heaters, boilers and oilfield steamers include a heater radiant section adjacent a burner. A precombustion chamber is mounted between the burner and the heater radiant section and is surrounded by a combustion air plenum. A plurality of spaced tubes form a perforated combustion chamber and extend from the air plenum axially into the heater radiant section and terminate in line and in converging relationship with the exiting products of combustion. The tubes are protected by refractory members positioned along each tube in abutting end to end relationship. A plurality of openings may be spaced along each tube for progressively staging combustion air.

4 Claims, 3 Drawing Figures

LOW $NO_x$ BURNERS

FIELD OF THE INVENTION

My invention is directed to staged combustion apparatus, and more particularly to an add-on unit for use with fired heaters, oilfield steamers, boilers and the like.

DESCRIPTION OF THE PRIOR ART

The need to minimize the formation of oxides of nitrogen during combustion has become a requirement over the last several years. Many existing fired heaters, boilers, oilfield steamers and other furnaces presently discharge emissions which do not meet present and projected stringent regulations for $NO_x$.

It is known that there are two basic sources of $NO_x$ formation, namely from the nitrogen in the air and further from the fuel bound nitrogen. The probable use of newly available synfuels containing large amounts of combined nitrogen as well as the increase in the need to conserve energy further increases the demand for low $NO_x$ emissions.

Certain principles of staged combustion are already known to minimize $NO_x$ formation. For example, staged combustion has successfully been employed to reduce $NO_x$ emissions. In staged combustion, a portion of the necessary air (less than stoichiometric) is mixed with the fuel in the primary zone and the balance of the air is injected into a downstream zone or zones where combustion is completed and the flame is cooled to limit the formation of $NO_x$. Various forms of combustion air tubes have been used in conjunction with the staging of combustion air. The utilization or recirculated flue gas is also known in multiple stage apparatus to reduce $NO_x$ formation.

While a number of solutions for low $NO_x$ furnace systems have been suggested for new installations, for example my application Ser. No. 198,057, a substantial number of existing installations continue to operate at unsatisfactory $NO_x$ levels and it is cost prohibitive and impractical to consider replacing all such units.

SUMMARY OF THE INVENTION

My invention permits staged combustion to be employed in existing oilfield steamers, fired heaters and the like. My add-on unit is compatible with most existing burner systems regardless of fuel and modifies those systems so as to provide staged combustion and low $NO_x$ emissions. My invention provides for refractory protection of the portion of the unit exposed to the products of combustion thereby preventing deterioration and increasing the overall useful life. My invention provides the necessary long residence time for proper combustion in the downstream combustion zone. In addition, the space at the burner end of the furnace chamber is subjected to proper heating.

My invention is an add-on unit for a combustion system having a heater radiant section and a burner capable of operating in a reducing mode for directing partially combusted products of combustion into the heater radiant section. The add-on unit includes a primary precombustion chamber mounted between the burner and heater radiant section. A combustion air plenum surrounds the primary precombustion chamber. A plurality of spaced tubes extend from the air plenum axially into the heater radiant section to form a secondary perforated combustion chamber and terminate in line with the partially combusted products of combustion exiting the primary precombusted chamber. The tubes terminate in a converging section and are protected by sections of refractory members positioned in abutting end to end relationship. In a preferred form of operation air preheat is directed to the burner and cooled flue gas to the add-on unit. In addition, staged secondary air may be achieved by the use of additional air ports in the perforated combustion chamber.

DESCRIPTION OF THE PREFERRED EMBODIMENTS

My add-on unit can be employed with a number of process furnaces, but it finds particular application to oilfield steamers which are used to generate steam for injecting into the ground to aid in the extraction of petroleum crude. The typical oilfield steamer includes a fire box or heater radiant section into which a burner fires its products of combustion. A number of such standard burners are in existence firing gas, crude or heavy oil or combinations thereof. Standard control modules accompany the basic burner for automatic, semi-automatic or manual operation. These controls and the details of the basic standard burners are known and do not form part of the subject invention.

Figure 1:
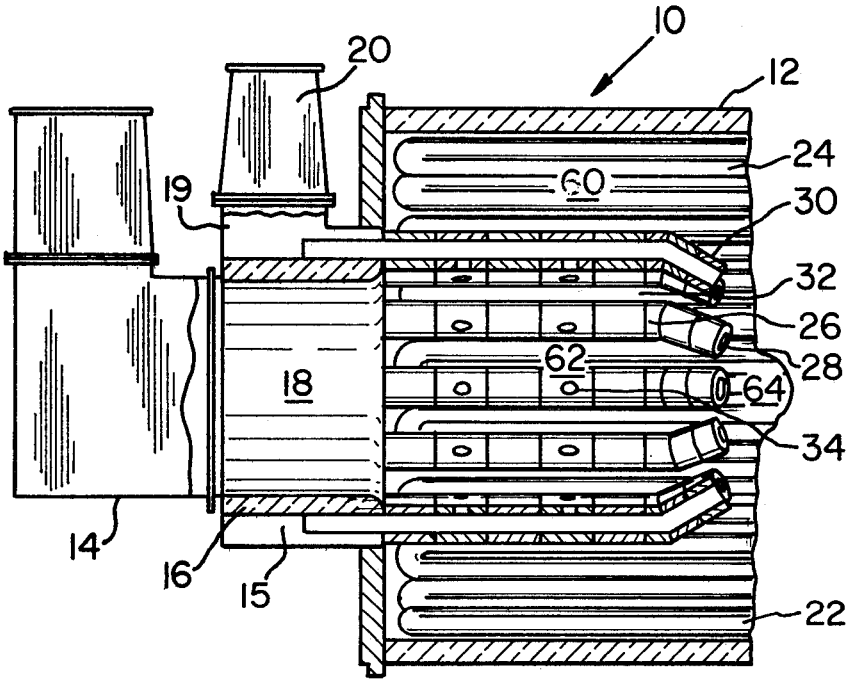
FIG. 1 is a partial section through an oilfield steamer showing my add-on unit.
Figure 2:
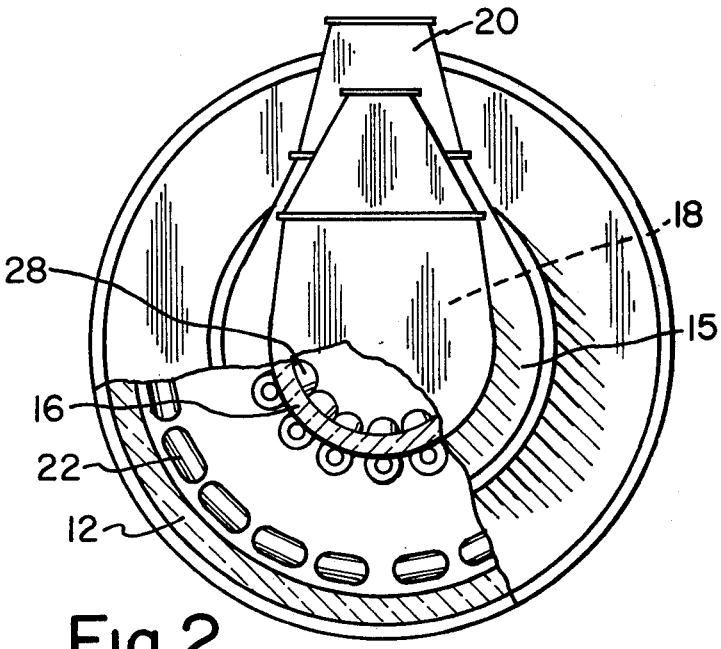
FIG. 2 is an end view and partial section showing the steamer of FIG. 1.
Figure 3:
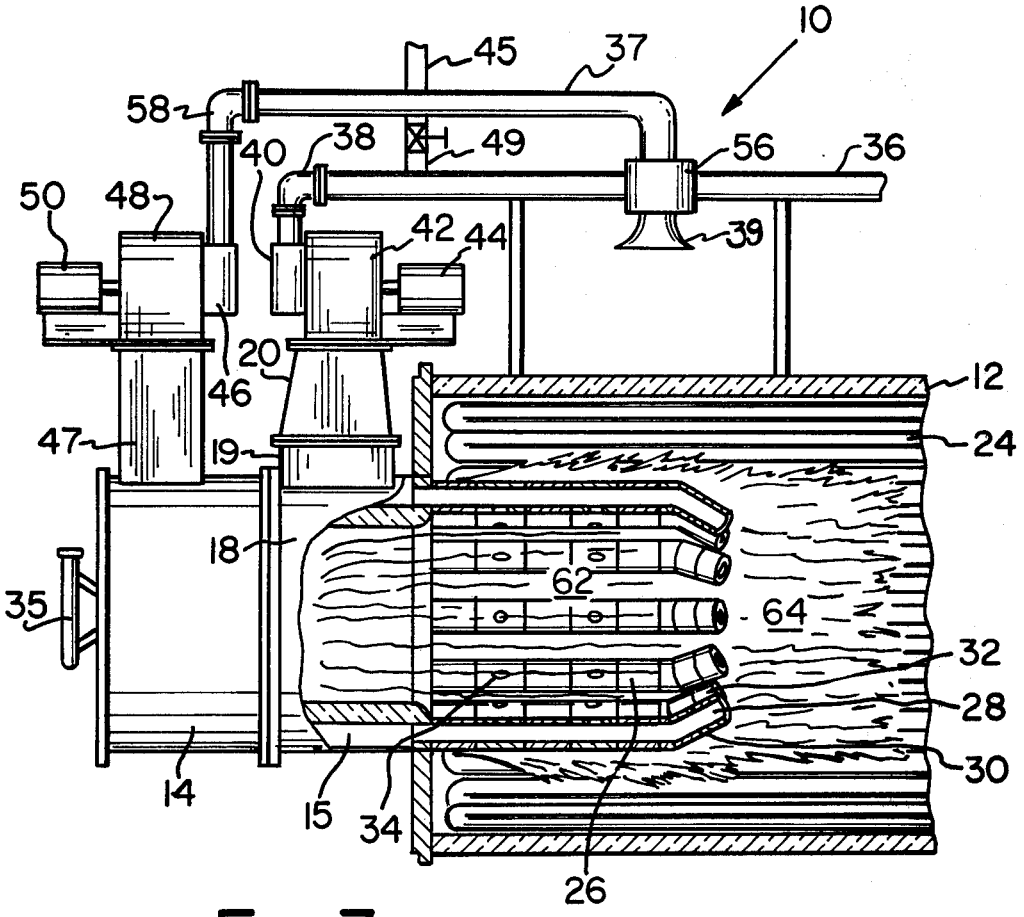
FIG. 3 is a side view and partial section of the system of FIG. 1, including the recirculated flue gas duct work in conjunction with my add-on unit.

The portion of the steamer, generally designated 10, embodying my add-on unit is illustrated in FIGS. 1–3. A refractory lined furnace 12 has mounted to it a steamer burner 14 of the standard type described hereinabove. A plurality of steam tubes 22 extend throughout the furnace 12 in the area of the furnace known as the radiant heater section 24.

My add-on unit includes a cylindrical chamber wall 16, defining the primary precombustion chamber 18 and which is mounted by conventional means between standard burner 14 and an end of furnace 12, FIGS. 1 and 2. A plenum air chamber 15 surrounds the chamber wall 16 and includes an air inlet 19 connected to an air inlet duct 20. A plurality of tubes 26 are connected along the perimeter of chamer wall 16 and extend axially and in parallel relationship into the radiant heater section 24. These tubes 26 are spaced so as to define a series of extended perforations 32 between the tubes 26. The perforations 32 define about 50% of the space and the tubes 26 define the remaining 50%. This results in optimum heating of the area at the burner end of the furnace.

These perforations 32 are in communication with the area 60 radially outward of the tubes as well as the area 62 radially inward of the tubes 26. Each tube 26 terminates in a tube end section 28 which is inclined radially inward so as to present a converging air stream into area 64 located at the exit end of the tubes 26.

Each tube 30 which is made of an appropriate steel or steel alloy is protected by means of a plurality of protective refractory section 30. These protective refractory sections 30 are positioned about the tubes 26 in abutting end to end relationship so as to provide a complete covering for the tubes 26. An appropriate protective refractory member is the product sold under the trademark K-weld and which is manufactured by Bloom Engineering Company, Inc.

The general arrangement and operation of an oilfield steamer embodying my invention is best seen in FIG. 3. The burner 14 has a multiple fuel gun 35 mounted at one end thereof to provide either gas or liquid fuel for combustion purposes. Air duct 47 connects to the burner 14 and provides approximately 70% of the total combustion air by means of a forced draft fan 48 driven by motor 50. This air can be preheated or mixed with the recirculated flue gases which are controlled by control damper 46.

The flue gas flows through duct 36 which extends along the furnace 12 from the exit stack (not shown). An appropriate heat exchanger 56 is mounted in conjunction with the flue gas duct 36 and a by-pass duct 37 extends from heat exchanger 36 through an elbow 58 to the control damper 46. An air inlet 39 provides air to be preheated by heat exchanger 56 prior to admission to burner 14.

The balance of the combustion air is fed into the plenum air chamber 15 through the air duct 20 which in turn connects to a forced draft fan 42 driven by a motor 44. This balance of air is the amount needed to complete combustion and provide the necessary excess air, e.g. 5 to 15%. A control damper 40 controls the flue gas and/or air mixture. Control damper 40 is fed directly by the flue gas duct 36 passing through the heat exchanger 56 and about an elbow 38 to the control damper 40. Fresh air in controlled amounts may likewise be introduced through duct 45 and valve 49 to be fed by damper 40 into the air chamber 15.

Primary combustion is initiated in a reducing mode at about 0.7 stoichiometric in the primary precombustion chamber 18. The partially combusted products of combustion enter the area 62 inward of the tubes 26. This area 62 is actually a secondary perforated combustion chamber. The balance of the air necessary to complete combustion and provide the desired excess air is provided through the add-on unit where it has been mixed with cooled flue gas. This balance of air is fed from chamber 15 into the tubes 26 and exits the tubes 26 in a converging manner through converging end sections 28 so as to mix with the partially spent products of combustion exiting the secondary perforated combustion area 62 in the area 64 immediately adjacent the ends of the tubes 26.

In a modified form of the invention a number of spaced air outlets 34 extend axially along the tubes 26 so as to form progressively staged air inside the secondary perforated combustion chamber.

The perforations are spaced between the tubes to allow heat transfer into the radiant section about the tubes. The flue gas mixed with the balance of the air provides a cooler flame which reduces $NO_x$ formation. The converging outlet of the tubes 26 provide for better mixing and operation at low excess air. The tubes which may be on the order of 8 to 10 feet long give more residence time. This increased residence time in a reducing combuston environment allows the fuel bound nitrogen compounds to break down into harmless $N_2$ and then the add-on unit provides the balance of the combustion air highly vitiated with flue gas either in a second stage or in a multistaged mode. In addition, flame impingement is eliminated on the steamer tubes in the radiant section. The air tubes of the add-on unit are self-cooled as well as being totally protected by the refractory members.

I claim:

1. In a combustion system such as a fired heater or oilfield streamer including a heater radiant section and a burner capable of operating in a reducing mode for directing partially combusted products of combustion into one end of said section, the improvement comprising a combustion add-on unit for staged combustion having:

A. a precombustion chamber defined by a chamber wall and mounted between the burner and the heater radiant section;

B. a combustion air plenum surrounding said precombustion chamber and including a combustion sustaining gas inlet;

C. a plurality of spaced tubes defining a perforated combustion chamber extending from the air plenum axially into said section and terminating in line with said partially combusted products of combustion and in spaced relationship to said precombustion chamber, said tubes terminating in a converging section and mounted to an exterior of said wall; and D. sections of protective refractory members positioned along each tube in abutting end to end relationship to protect said tubes within said section.

2. The improvement of claim 1 including a plurality of openings spaced along each tube for progressively staging exit combustion sustaining gas.

3. The improvement of claim 1, wherein a relationship of area of tubes to area of space between tubes is on the order of 1 to 1.

4. A furnace system for oilfield steamers, fired heaters and the like comprising:

A. a refractory lined furnace chamber having a flue gas stack exiting therefrom;

B. a precombustion chamber mounted at one end of the furnace;

C. a burner mounted to the precombustion chamber for directing fuel and air in a reducing mode into the precombustion chamber and partially burned products of combustion into the furnace chamber;

D. a combustion air plenum surrounding said precombustion chamber;

E. a plurality of spaced refractory protected tubes defining a perforated combustion chamber extending from the air plenum axially into the furnace chamber and terminating in line and in converging relationship with the products of combustion and spaced from said precombustion chamber, each tube including a plurality of openings spaced therealong for progressively staging the exit of the secondary combustion air;

F. a plurality of protective refractory elements positioned about each tube and in abutting end to end relationship; and G. a recirculating flue gas duct extending from said flue gas stack along said furnace chamber and in communication with said burner and said combustion air plenum.

* * * * *